US005590759A

United States Patent [19]

Hawkins et al.

[11] Patent Number: 5,590,759

[45] Date of Patent: Jan. 7, 1997

[54] FIRE ALARM EXTENSION APPARATUS AND METHOD

[75] Inventors: J. Riley Hawkins; Nicole E. Hawkins, both of Atlanta, Ga.

[73] Assignee: Georgia Tech Research Corporation, Atlanta, Ga.

[21] Appl. No.: 383,413

[22] Filed: Feb. 3, 1995

[51] Int. Cl.[6] ..... H01H 17/14

[52] U.S. Cl. ..... 200/331; 200/543

[58] Field of Search ..... 200/331, 334, 200/543

[56] References Cited

U.S. PATENT DOCUMENTS

| | | | |
|---|---|---|---|
| 3,827,039 | 7/1974 | Agnese | 200/331 X |
| 3,916,134 | 10/1975 | Hansen | 200/331 |
| 3,939,725 | 2/1976 | Fisher | 74/503 |
| 4,745,243 | 5/1988 | Wang | 200/331 |
| 4,870,232 | 9/1989 | Hoogland | 200/331 |
| 5,219,066 | 6/1993 | Jameson | 200/42.01 |
| 5,448,031 | 9/1995 | Concannon et al. | 200/331 |

OTHER PUBLICATIONS

Firecom, *Pull Plus* Brochure, Woodside, New York, 1995, pp. 1–2.

*Primary Examiner*—Renee S. Luebke

*Attorney, Agent, or Firm*—Hopkins & Thomas

[57] ABSTRACT

Fire alarm extension apparatuses (30, 100) permit actuation of a fire alarm pull switch (11, 21) by persons with a handicap by lowering the position at which the fire alarm pull switch (11, 21) can be actuated. The fire alarm extension apparatuses (30, 100) each comprise a clip (33, 133) for attachment to a pull lever (14, 24) of the fire alarm pull switches (11, 21). An elongated member (32, 132) is attached to the clip (33, 133) for permitting movement of the clip (33, 133) and the pull lever (14, 24) while at a position remote from the pull lever (14, 24) in a direction to permit actuation of the fire alarm pull switch (11, 21). In a first embodiment (30), the elongated member (33) is a flat rigid shaft which is mounted to a wall (31) via a mounting block (36) and is guided by dual parallel rails (37*a*, 37*b*) situated on the mounting block (36). Further, the lever (14, 24) is engaged by a C-shaped clip (33), and the shaft (32) has a T-shaped handle (34). In a second embodiment (100), the elongated member (132) is a coated wire which permits pivotal movement of the lever (14, 24) as well as the cover (12, 22) without mechanical stress to the apparatus (100). Further, the second embodiment has a frictional mechanism (151*b*) for inhibiting movement of the cord (132) for preventing inadvertent actuation of the switch (11, 21) and a mechanism (152, 153) for ensuring that a slanted-L-shaped handle (134) remains in a desirable posture for easy grasping by a person.

8 Claims, 5 Drawing Sheets

FIRE ALARM EXTENSION APPARATUS AND METHOD

FIELD OF THE INVENTION

The present invention generally relates to fire alarm systems in buildings, and more particularly, to a fire alarm, extension apparatus and method for permitting remote actuation of a fire pull switch by, particularly, persons with a handicap, or disability.

BACKGROUND OF THE INVENTION

A conventional fire alarm system which is installed in a building has numerous fire alarm pull switches situated throughout the building for actuating the fire alarm system. There are two common types of fire alarm pull switches. One common type is produced by the Edwards Company, Massachusetts, U.S.A., and the other is produced by the Simplex Corporation, U.S.A. These types of switches are briefly described hereafter.

A front elevational view of the Edwards fire alarm pull switch is illustrated in FIG. 1A and is generally denoted by reference numeral 11. As shown in FIG. 1A, the Edwards fire alarm pull switch 11 has a cover 12 which protrudes slightly outwardly from a wall in a convex configuration. The cover 12 has an inwardly protruding cavity 13. A rectangular-shaped pull lever 14 is disposed in front of the cavity 13 and is slightly curved inwardly near its top end 14*a* (best shown in FIG. 6). The pull lever 14 is mounted with a hinge so that it can be pivoted outwardly and downwardly in order to actuate the fire alarm pull switch 11. The cavity 13 enables the fingers of a person to be placed behind the pull lever 14 to facilitate movement of the lever 14. Moreover, the cover 14 of the switch 11 is hinged at its lower end 12*b* so that the cover 12 can be moved outwardly and downwardly from the wall, while pivoting about the end 12*b*, so that the internal mechanism of the fire alarm pull switch 11 is exposed and so that the switch 11 can be reset after the pull lever 14 has been pulled.

The Simplex fire alarm pull switch is illustrated in FIG. 1B and generally denoted by reference numeral 21. As shown in FIG. 1B, the Simplex fire alarm pull switch 21 also comprises a cover 22 which is hinged at an end 22*b* for pivoting the cover 22 outwardly and downwardly from the wall about a bottom end 22*b*. Further, the Simplex fire alarm pull switch 21 has a cavity 23 and a T-shaped pull lever 24 disposed in front of the cavity 23, which is hinged at an end 24*b* so that the T-shaped pull lever 24 can be pivoted outwardly about the end 24*b*.

Current United States law, specifically, the Americans With Disabilities Act (ADA) of 1990, requires that fire alarm pull switches, including those shown in FIGS. 1A and 1B, must be located below the maximum reach range of 48 inches or below 54 inches, if there is a guarantee of clear floor space, so that persons with a handicap can operate such switches. Moreover, there are millions of alarm pull switches in the United States which do not meet the height requirements and therefore must be moved.

However, moving an alarm pull switch to accommodate the height requirements would usually require splicing the fire alarm wires, but splicing such wires is prohibited by municipal fire and electrical codes as well as other laws. Accordingly, a fresh run of wire from the switch to the main fire alarm console is typically required in order to move a switch. Such a requirement can result in the use of miles of wire in large commercial and public complexes and, hence, a huge expense.

SUMMARY OF THE INVENTION

An object of the present invention is to provide a system and method for ensuring that fire alarm pull switches conform to the U.S. Americans With Disabilities Act (ADA) of 1990.

Another object of the present invention is to provide a fire alarm extension apparatus and method for adapting a fire alarm pull switch so that it conforms to the ADA.

Another object of the present invention is to provide a solution for conforming fire alarm pull switches to the ADA without having to rewire switches to the main fire alarm console or elsewhere.

Another object of the present invention is to provide an apparatus and method for conforming the fire alarm pull switches to the ADA in an inexpensive, efficient, and reliable manner.

Another object of the present invention is to provide an apparatus and method for conforming a fire alarm pull switch to the ADA in a simple yet effective manner.

Briefly described, the present invention provides for several novel embodiments of a fire alarm extension apparatus having associated novel methodology. In these embodiments, an elongated member is attached to a pull lever of a fire alarm pull switch by a lever attachment mechanism, for example, a clip. Moreover, the elongated member is secured to the wall with a mounting guide mechanism which permits movement of the elongated member in a direction to permit movement of the pull lever and actuation of the fire alarm pull switch.

In a first embodiment, a flat rigid shaft, preferably plastic, is utilized as the elongated member. The flat rigid shaft has a C-shaped clip or other suitable lever attachment mechanism at one end for engaging and pulling on a pull lever of a fire alarm pull switch and a handle (preferably T-shape) at the other end which can be grasped by a person for moving the lever at a remote location. The shaft is secured to the wall, while guided movement of the shaft is permitted in a direction toward and away from the lever via a mounting block. The mounting block, preferably plastic, has dual parallel guide rails for guiding the shaft along its longitudinal length. The mounting block is affixed to the wall via any conventional apparatus, including but not limited to, a screw, sticky pad, hook and loop arrangement (such as Velcro), etc. The first embodiment is very simple in design and extremely inexpensive.

In a second embodiment of the present invention, an elongated member in the form of a cord, preferably a coated wire, is attached to the pull lever of the fire alarm pull switch via a clip or other suitable lever attachment mechanism. Moreover, the cord is passed through a mounting block adapted to secure the cord to the wall, while permitting movement of the cord in a direction toward and away from the pull lever to permit actuation of the fire alarm pull switch. The cord is structurally superior to the rigid shaft in the first embodiment in that it permits pivotal movement of the pull lever outwardly from the wall and permits pivotal movement of the fire alarm cover outwardly from the wall so that the fire alarm pull switch can be reset, both of which can occur without any attendant structural stress to and breakage of the apparatus.

A handle with a slanted-L-shaped hook configuration is situated at the distal end of the cord. The slanted-L-shaped hook configuration of the handle permits easier grasping by a person, particularly a person with a handicap. Further, the mounting mechanism and the handle are configured to engage and mate with each other so that the handle is maintained at a particular horizontal posture for easier grasping by a person.

The mounting block has a friction mechanism, preferably a grooved aperture with a particular diameter, which inhibits movement of the cord in a direction toward and away from the pull lever. The frictional force applied by the friction mechanism to the cord is sufficient to counteract the weight (imposed by gravity) associated with the cord and handle so that the weight does not inadvertently actuate the pull lever, but is weak enough to permit easy actuation of the switch by a person. In fact, the weight of a person's hand is generally enough to pull the lever switch with the novel apparatus.

Also in the second embodiment, a novel clip accommodates various pull lever types. The clip has a cross section in the form of an interrogation symbol (a.k.a. question mark; i.e., "?"). It has an internal cavity for receiving a pull lever which is either linear in configuration or curvilinear in configuration, for example but not limited to, the Edwards and Simplex pull levers, respectively. Moreover, the clip has a pair of orthogonal set screws for securely fastening the clip to a pull lever.

Other objects, features, and advantages of the present invention will become apparent to one of skill in the art upon examination of the following drawings and detailed description. Any such additional objects, features, and advantages are intended to be included herein within the scope of the present invention.

BRIEF DESCRIPTION OF THE DRAWINGS

The present invention can be better understood with reference to the following drawings, the drawings are not necessarily to scale, emphasis instead being placed upon clearly illustrating principles of the present invention.

DETAILED DESCRIPTION OF THE PREFERRED EMBODIMENTS

Figure 1A:
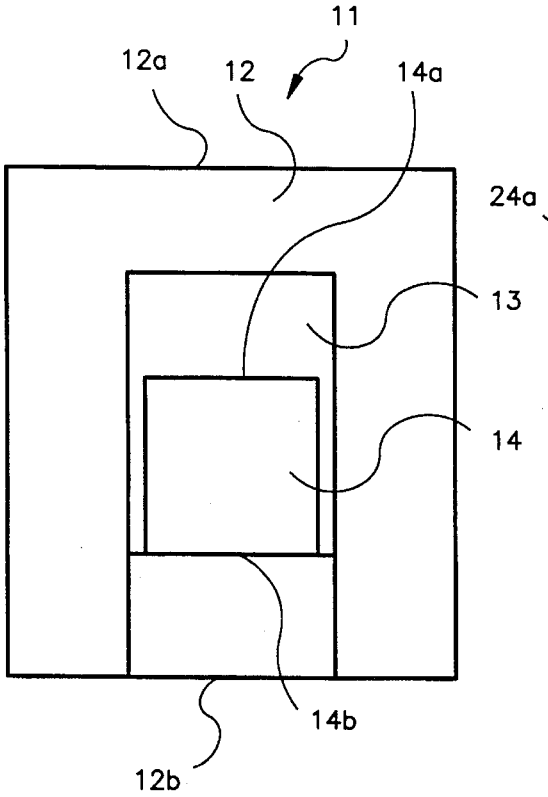
FIG. 1A (PRIOR ART)
FIG. 1A is a front elevational view of a first type (i.e., Edwards) of a conventional fire alarm pull switch.
Figure 1B:
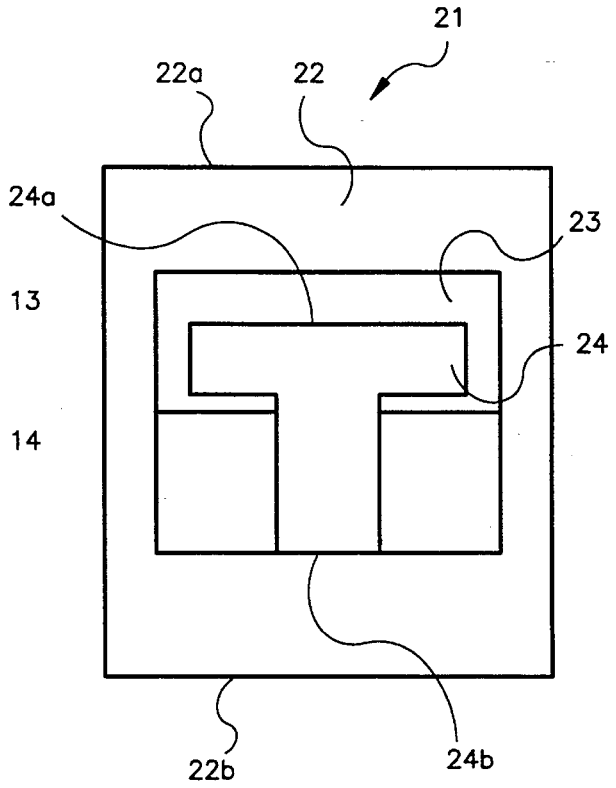
FIG. 1B (PRIOR ART)
FIG. 1B is a front elevation view of a second type (i.e., Simplex) of a conventional fire alarm pull switch.
Figure 2A:
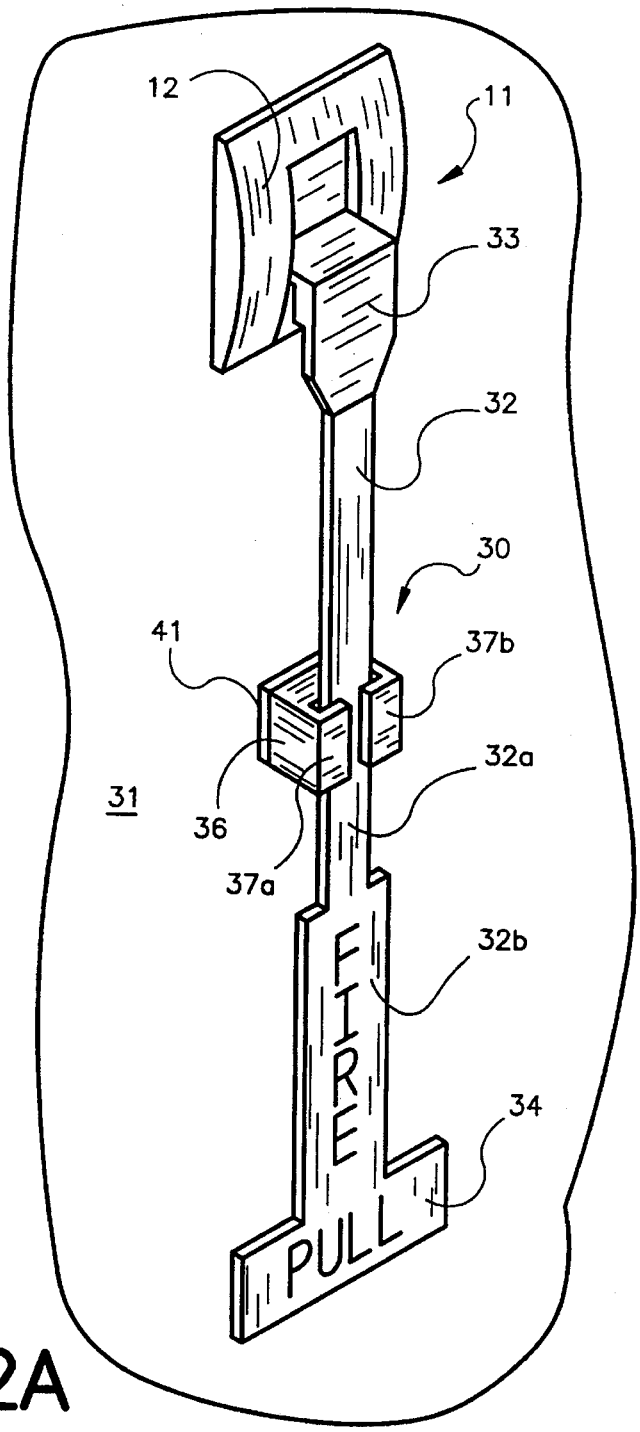
FIG. 2A is a perspective view of a first embodiment of a fire alarm extension apparatus in accordance with the present invention.
Figure 2B:
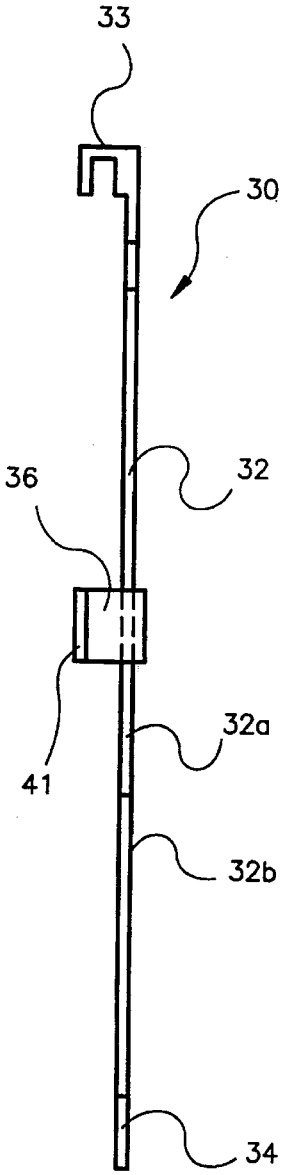
FIG. 2B is a cross-sectional view of the fire alarm extension apparatus of FIG. 2A.
Figure 3:
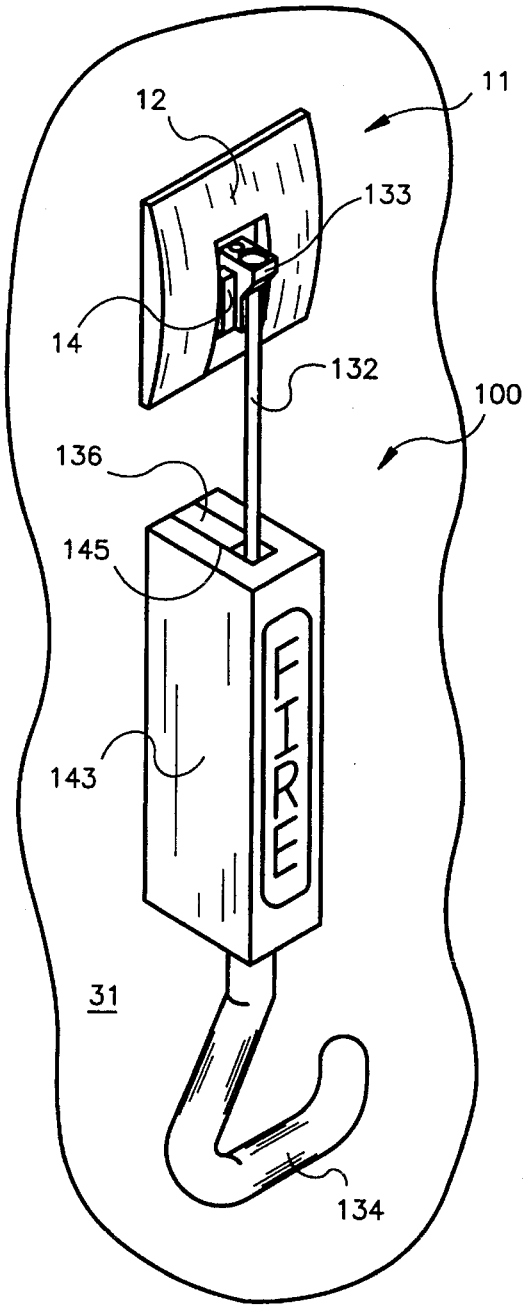
FIG. 3 is a perspective view of a second embodiment of a fire alarm extension apparatus in accordance with the present invention.

With reference now to the drawings wherein like reference numerals designate corresponding parts throughout the several views, the first embodiment of the fire alarm extension apparatus of the present invention is illustrated in FIGS. 2A and 2B and is generally denoted as reference numeral 30. The fire alarm extension apparatus 30 is shown in FIG. 2A mounted to a wall 31 for permitting actuation of a fire alarm pull switch 11, which is shown by way of example as an Edwards type switch. It should be emphasized that the several embodiments of the present invention can be utilized in connection with various types of fire alarm pull switches, including but not limited to, the Edwards type and the Simplex type, as described previously relative to FIGS. 1A and 1B, respectively.

The fire alarm extension apparatus 30 has an elongated flat shaft 32, preferably plastic, with a lever attachment mechanism 33 at one end for engaging the pull lever 14 (FIG. 1A) of the fire alarm pull switch 11 and a handle 34 at the opposing distal end. It is possible that the shaft 32 could be configured as a combination of interworking elements. The lever attachment mechanism 33 is produced In the form of C-shaped clip in the preferred embodiment, bun obviously many other suitable attachment/mounting mechanisms are possible, for instance, a nut and screw arrangement. Further, the handle 34 is preferably formed with a T-shaped configuration, but, as with the shaft and clip, many other suitable embodiments are possible. The handle 34 permits movement of the switch lever 14 at a position which is remote from the fire alarm pull switch 11 and, particularly, at a lower vertical level which conforms with the ADA of 1990. Moreover, in a preferred embodiment, the shaft 32 has two shaft regions **32*a*, 32*b* with different widths. The region 32*b* is designed to have a larger width than the region 32*a*** which permits writing, such as "fire," to be written in large letters for greater visibility.

The shaft 32 is secured to the wall 31 via a substantially rectangular mounting block 36, which is also plastic in the preferred embodiment, but obviously use of other materials is possible. The mounting block 36 has elongated dual parallel guide rails **37*a*, 37*b*, each having a substantially C-shaped cross section, for receiving the shaft at opposite side edges and guiding the shaft 32 along its longitudinal length. The mounting block 36 essentially enables movement of the shaft 32 in a direction to and away from the pull lever 14, but prevents movement of the shaft 32 in a direction which is transverse to the foregoing direction. This is significant in that it maintains the handle 34 in a desirable fixed posture for easy grasping by a person. The mounting block 36 is affixed to the wall 31** via any conventional mechanism, such as a screw(s), sticky pad, hook and loop arrangement, etc.

The second embodiment of the fire alarm extension apparatus in accordance with the present invention is illustrated in FIGS. 3 through 6 and is generally denoted as reference numeral 100. The fire alarm extension apparatus 100 is mounted to the wall 31 and permits actuation of the fire alarm pull switch 11 at a location which is remote from the pull lever 14, and particularly, at a location which is much lower vertically to comply with the ADA of 1990 so that persons with a handicap can actuate the switch 11. The fire alarm extension apparatus 100 has a substantially flexible cord 132 which has a lever attachment mechanism 133 in the preferred form of a clip situated at one end for engaging the pull lever 14 of the switch 11 and a handle 133 situated at the other end of the cord 132 for pulling the cord 132 in a direction away from the switch lever 14. Preferably, the handle 134 is formed in a slanted-L configuration with a generally cylindrical cross section and is manufactured from nylon, but many other materials would obviously be suitable. The slanted-L-shaped handle 134 has a sideways oriented opening which permits a person to easily grasp and pull on the handle 134. Further, the slanted-L-shaped handle 134 provides a grasping member which is transverse to the direction of pull for easier movement thereof.

The cord 132 in the preferred embodiment is model 20945v4 stainless steel wire with a vinyl coating manufactured by and commercially available from Sara Industries, Inc., New Jersey, U.S.A. However, many other suitable materials for the cord 132 are possible. Moreover, single shank balls 154, which are preferably model no. 664-C3 manufactured by and commercially available from Cableware Technology Corporation, Florida, U.S.A., are affixed to the ends of the cord 132 for securing the ends to the clip 133 and the handle 134. At the handle end, the ball 154 is situated within a cylindrical aperture 156 and the cord 132 is permitted to pass through a vertically-oriented grooved channel 157 connecting the aperture 156 to the top of the handle 134. Furthermore, at the clip end, the ball 154 is situated and rests within a cylindrical cavity 161 located in the top of the clip 133.

The cord 132 is secured in close proximity to the wall 31 via a mounting block 136 having a cover 143, which slides over the mounting block 136 and fits snug. The cover 143 has a slot 145 for receiving and surrounding the cord 132 when the cover is in place on the mounting block 136. Further, the cover is preferably plastic in construction, can be appropriately decorated, can include a decal(s), and may have braille writing disposed thereon for the blind, if desired.

Figure 4:
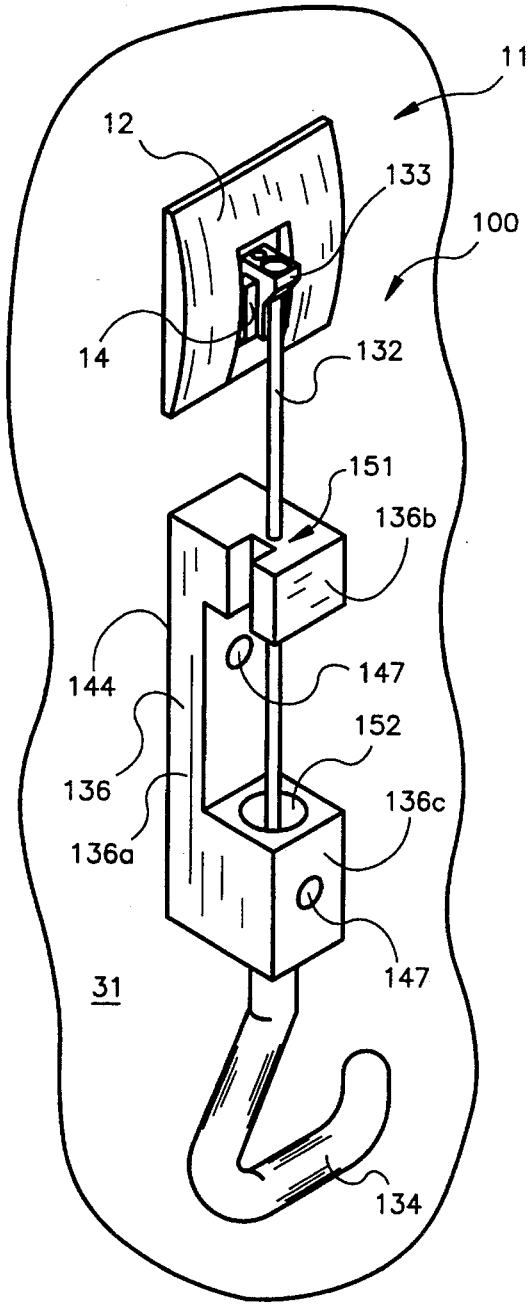
FIG. 4 is a perspective view of the fire alarm extension apparatus of FIG. 3 with its cover removed.
Figure 5:
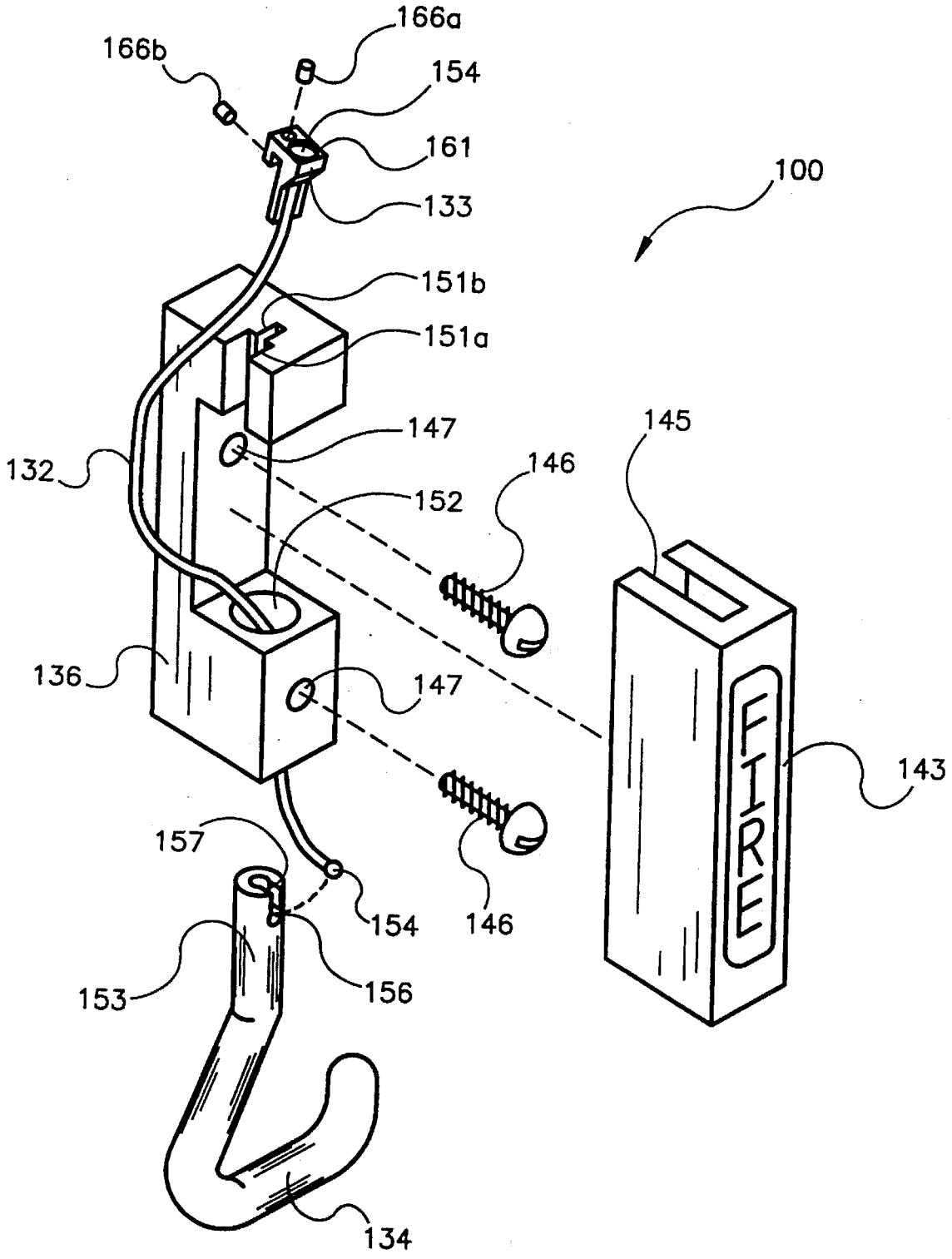
FIG. 5 is an assembly view of the fire alarm extension apparatus of FIGS. 3 and 4.

As shown in FIGS. 4 and 5, the mounting block 136, also preferably plastic or any other suitable material, is C-shaped with a back surface 144 for securing contiguous with the wall 31. Screws 146 pass through apertures 147 in the mounting block 136 in order to secure the mounting block 136 to the wall 31. The mounting block 136 has a central region **136*a*, an upper end region 136*b* which protrudes outwardly from the wall 131, and a lower end region 136*c* which also protrudes outwardly from the wall 31. The upper end region 136*b* has an elongated two-step groove aperture 151 with a large width region 151*a* and a small width region 151*b*. The smaller width region 151*b* is situated centrally with respect to the large width region 151*a*. Moreover, the cord 132 is passed through the small width region 151*b* and is sized to impart frictional force against movement of the cord 132 therethrough. The small region 151*b* provides sufficient frictional force to counteract the weight associated with the combination of the clip 133, cord 132, and handle 134 so that the weight does not inadvertently move the pull lever 14, while permitting the switch lever 14 to be easily actuated by a person via pulling the handle 134** in a downward direction.

It is envisioned that a force for inhibiting movement of the cord 132 to counteract the weight of the clip 133, cord 132, and handle 134 could be applied by other mechanisms. For instance, a pulley mechanism (not shown) having the cord 132 passed therethrough could be employed for inhibiting movement of the cord, while permitting actuation of the switch lever 14 by a person. As another example, a clamping mechanism (not shown) could be utilized for affirmatively binding the cord 132. There are numerous other possibilities.

The lower end region **136*c* has an elongated cylindrical aperture 152 which is substantially aligned with and receives the cord 132 therethrough. The cylindrical aperture 152 is sized in diameter to freely accept an upper elongated vertically-oriented portion 153 of the slanted-L-shaped handle 134. The portion 153 slides into and generally mates with the aperture 152. Based upon this mating configuration, the mounting block 136 prevents the handle 134 from moving in a direction transverse to the movement direction of the cord 132, while permitting movement of the cord 132 in a direction to and away from the switch lever 14**.

Figure 6:
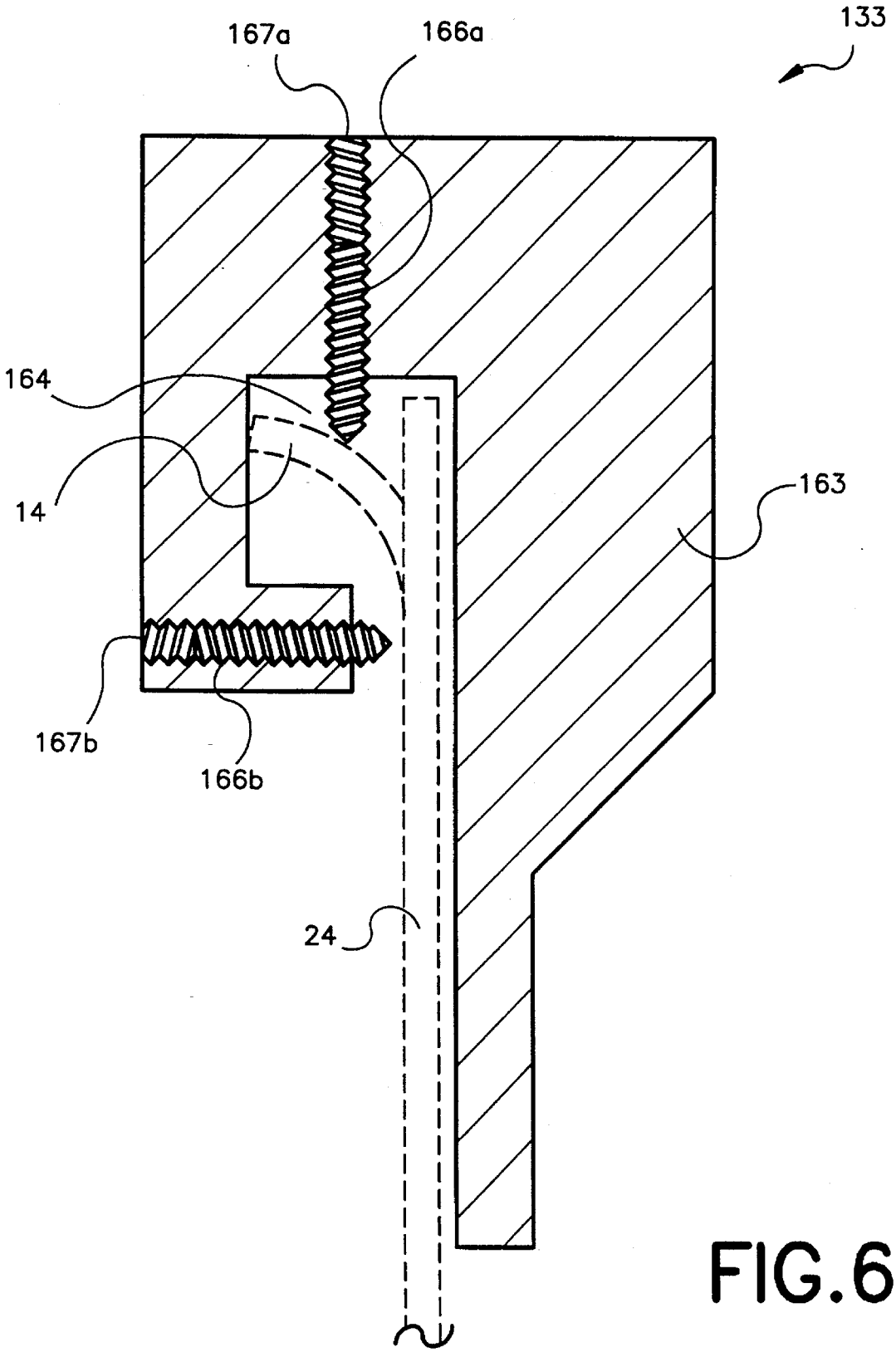
FIG. 6 is an exploded cross-sectional view of a clip associated with the second embodiment of the fire alarm extension apparatus as shown in FIGS. 3 through 5.

An exploded cross-sectional view of the novel clip 133 is illustrated in FIG. 6. The clip 133 has a cross section in the form of an interrogation symbol, or mark (a.k.a. question mark; i.e., "?"). Within the clip body is an internal cavity 164. First and second set screws **166*a*, 166*b* pass through orthogonally arranged threaded apertures 167*a*, 167*b*. The set screws 166*a*, 166*b* are threaded through the respective apertures 166*a*, 167*b* to the extent necessary to bind and attach the clip 133 to the levers 14, 24 (FIGS. 1A, 1B) of the switches 11, 21 (FIGS. 1A, 1B). When the clip 133 is to be affixed to the lever 14, both of the set screws 166*a*, 166*b* are adjusted to contact the lever 14 so that the clip 133 is rigidly affixed to the lever 14. Because the Edwards switch lever 14 is curvilinear, as is shown in FIG. 6, the set screw 167*a* is significant. If the set screw 167*a* were not present, then the clip 133 would have a tendency to move relative to the lever 14 and perhaps be disengaged from the lever 14. In contrast, in the case when the clip 133 is affixed to the Simplex switch lever 24, the set screw 166*b* alone is sufficient to affect rigid fixed engagement therebetween. Hence, the unique design of the clip 133** permits attachment to, among others, the two primary configurations of the switch lever.

It will be obvious to those skilled in the art that many variations and modifications may be made to the preferred embodiments as described above without departing substantially from the spirit and scope of the present invention. It is intended that all such variations and modifications be included herein within the scope of the present invention, as is set forth in the following claims.

Wherefore, the following is claimed:

1. A remote actuator assembly for actuating a fire alarm switch mounted on a surface from a location on the surface remote from the location of the switch, said assembly comprising a clip engaging the fire alarm switch for actuating the switch upon movement of said clip, a cord extending from said clip to a distal end located remote from the location of the switch, a handle secured to said distal end of said cord, a mounting bracket for securing said cord to the surface at a location intermediate the fire alarm switch and said handle, said mounting bracket having at least one aperture through which said cord extends, said aperture being sized to impart sliding friction to said cord as said cord moves in said aperture for yieldably resisting movement of said cord in said aperture.

2. A remote actuator assembly as claimed in claim 1 and wherein said cord extends vertically downwardly from said clip and wherein said mounting bracket is formed with a pair of vertically spaced apertures through which said cord extends.

3. A remote actuator assembly as claimed in claim 1 and wherein said aperture is open along one side for receiving said cord.

4. A remote actuator assembly as claimed in claim 1 and further comprising a cover for covering said mounting bracket.

5. An apparatus for permitting remote actuation of a fire alarm pull switch by persons with a handicap, said apparatus comprising:

a lever attachment mechanism for connection to a pull lever of the fire alarm pull switch;

an elongated member attached to said lever attachment mechanism for permitting movement of said lever attachment mechanism and said pull lever while at a position remote from said pull lever in a direction to permit actuation of said fire alarm pull switch;

a mounting guide mechanism for mounting said elongated member to a surface;

means for inhibiting movement of said elongated member in said direction, said means for inhibiting comprising an aperture in said mounting guide mechanism of a sufficient size to impart a frictional force against said elongated member;

said elongated member comprising a cord; and wherein said means for inhibiting comprises at least one aperture situated in said mounting guide mechanism, said aperture adapted to receive said cord and being of a size to permit said cord to slide therethrough while imparting frictional force to said cord.

6. An apparatus for lowering a position at which a fire alarm pull switch can be actuated so that persons with a handicap can operate said fire alarm pull switch, comprising:

movement means for permitting movement of a pull lever of the fire alarm pull switch, said movement means being located on a wall at a distance remote from the pull lever;

a lever attachment attaching said movement means to said pull lever;

a wall mount securing said movement means to the wall while permitting movement in a direction to permit movement of the pull lever and actuation of the fire alarm pull switch;

friction imparting means for inhibiting said movement of said movement means;

a handle detachably secured to said movement means, said handle formed generally in the shape of an interrogation symbol.

7. An apparatus for lowering a position at which a fire alarm pull switch can be actuated so that persons with a handicap can operate said fire alarm pull switch, comprising:

movement means for permitting movement of a pull lever of the fire alarm pull switch, said movement means being located on a wall at a distance remote from the pull lever;

a lever attachment attaching said movement means to said pull lever;

a wall mount securing said movement means to the wall while permitting movement in a direction to permit movement of the pull lever and actuation of the fire alarm pull switch;

friction imparting means for inhibiting said movement of said movement means;

said wall mount comprising an elongated wall piece with at least two apertures which are spaced apart for slidably receiving and guiding said movement means therethrough, and at least two apertures for receiving attachment means for fixedly securing said mount to the wall.

8. An apparatus for lowering a position at which a fire alarm pull switch can be actuated so that persons with a handicap can operate said fire alarm pull switch, comprising:

movement means for permitting movement of a pull lever of the fire alarm pull switch, said movement means being located on a wall at a distance remote from the pull lever;

a lever attachment attaching said movement means to said pull lever;

a wall mount securing said movement means to the wall while permitting movement in a direction to permit movement of the pull lever and actuation of the fire alarm pull switch;

friction imparting means for inhibiting said movement of said movement means;

said friction imparting means comprising an aperture in said wall mount;

said elongated member comprising a cord and wherein said friction imparting means in an aperture situated in said mount, said aperture adapted to receive said cord and being of a size to permit said cord to slide therethrough while imparting frictional force to said cord.

* * * * *